US012305512B2

(12) United States Patent
Xu et al.

(10) Patent No.: US 12,305,512 B2
(45) Date of Patent: May 20, 2025

(54) SHORT-RADIUS TRAJECTORY-CONTROLLABLE DRILLING TOOL AND COMBINED TYPE STEERABLE DRILLING TOOL

(71) Applicant: Xiaoyue Wan, Beijing (CN)

(72) Inventors: Zichen Xu, Beijing (CN); Zhonghua Yang, Beijing (CN); Xiaoyue Wan, Beijing (CN)

(73) Assignee: Xiaoyue Wan, Beijing (CN)

( * ) Notice: Subject to any disclaimer, the term of this patent is extended or adjusted under 35 U.S.C. 154(b) by 0 days.

(21) Appl. No.: 18/020,885

(22) PCT Filed: Oct. 11, 2021

(86) PCT No.: PCT/CN2021/123139
§ 371 (c)(1),
(2) Date: Aug. 28, 2023

(87) PCT Pub. No.: WO2022/033610
PCT Pub. Date: Feb. 17, 2022

(65) Prior Publication Data

US 2024/0263519 A1 Aug. 8, 2024

(30) Foreign Application Priority Data

| | | |
|---|---|---|
| Aug. 10, 2020 | (CN) | 202010797032.4 |
| Nov. 27, 2020 | (CN) | 202011358603.0 |
| Jul. 19, 2021 | (CN) | 202110814025.5 |

(51) Int. Cl.

| | |
|---|---|
| ***E21B 17/10*** | (2006.01) |
| ***E21B 7/06*** | (2006.01) |
| ***E21B 17/04*** | (2006.01) |

(52) U.S. Cl.
CPC ..... *E21B 7/061* (2013.01); *E21B 7/06* (2013.01); *E21B 17/04* (2013.01); *E21B 17/1078* (2013.01)

(58) Field of Classification Search
CPC ..... E21B 7/06; E21B 17/04; E21B 17/1078
See application file for complete search history.

(56) References Cited

U.S. PATENT DOCUMENTS

| | | | |
|---|---|---|---|
| 3,974,886 | A | 8/1976 | Blake, Jr. |
| 5,311,953 | A | 5/1994 | Walker |

(Continued)

FOREIGN PATENT DOCUMENTS

| | | | |
|---|---|---|---|
| CN | 1263977 | A | 8/2000 |
| CN | 101078335 | A | 11/2007 |

(Continued)

OTHER PUBLICATIONS

International Search Report for corresponding International Patent Application No. PCT/CN2021/123139, dated Jan. 12, 2022.

(Continued)

*Primary Examiner* — Catherine Loikith
(74) *Attorney, Agent, or Firm* — LOZA & LOZA LLP; Michael Fedrick

(57) ABSTRACT

A short-radius trajectory-controllable drilling tool and a combined type steerable drilling tool, including a drill bit and a controllable flexible WOB and torque transmission drilling string. The controllable flexible WOB and torque transmission drilling string includes a deflecting lever and a plurality of load-bearing joints. A lower end of the deflecting lever is fixedly connected to the drill bit. Every two adjacent load-bearing joints are hinged by means of a deflectable WOB and torque transmission assembly. The lowermost load-bearing joint is a load-bearing body, and a steering actuator is disposed on the load-bearing body. A lower (Continued)

portion of the deflecting lever is hinged to a lower portion of the loading-bearing body by means of a controllable WOB and torque deflection transmission assembly.

19 Claims, 7 Drawing Sheets

(56) References Cited

U.S. PATENT DOCUMENTS

| | | | | |
|---|---|---|---|---|
| 9,689,212 | B2 * | 6/2017 | Van Nieuwkoop | E21B 7/06 |
| 12,168,930 | B2 * | 12/2024 | Xu | E21B 17/20 |
| 2006/0254827 | A1 | 11/2006 | Orban | |
| 2008/0110674 | A1 | 5/2008 | Jones et al. | |
| 2009/0086576 | A1 | 4/2009 | Downton et al. | |
| 2016/0319655 | A1 | 11/2016 | Awadh et al. | |
| 2024/0263519 | A1 | 8/2024 | Xu et al. | |

FOREIGN PATENT DOCUMENTS

| | | | |
|---|---|---|---|
| CN | 201053294 | Y | 4/2008 |
| CN | 101705787 | A | 5/2010 |
| CN | 103352656 | A | 10/2013 |
| CN | 107701107 | A | 10/2017 |
| CN | 108035677 | A | 11/2017 |
| CN | 107676040 | A | 2/2018 |
| CN | 107701107 | | 2/2018 |
| CN | 107882507 | A | 4/2018 |
| CN | 108412425 | A | 8/2018 |
| CN | 108952575 | A | 12/2018 |
| CN | 109458134 | A | 3/2019 |
| CN | 109854174 | A | 6/2019 |
| CN | 110485923 | | 11/2019 |
| CN | 110485923 | A | 11/2019 |
| CN | 110617011 | | 12/2019 |
| CN | 110617011 | A | 12/2019 |
| CN | 111173452 | A | 5/2020 |
| CN | 111287658 | A | 6/2020 |
| CN | 112267830 | | 1/2021 |
| CN | 112267830 | A | 1/2021 |
| CN | 112267831 | A | 1/2021 |
| CN | 12855024 | A | 5/2021 |
| CN | 112832681 | A | 5/2021 |
| CN | 112901075 | A | 6/2021 |
| CN | 213597871 | U | 7/2021 |
| CN | 213597872 | U | 7/2021 |
| CN | 113404429 | | 9/2021 |
| CN | 113404429 | A | 9/2021 |
| RU | 2613364 | | 3/2017 |
| RU | 2613364 | C1 | 3/2017 |
| WO | 2022033609 | A3 | 2/2022 |
| WO | 2022033610 | A1 | 2/2022 |
| WO | 2022083601 | A1 | 4/2022 |
| WO | 2022083602 | A1 | 4/2022 |

OTHER PUBLICATIONS

Office Action dated Aug. 26, 2022 for counterpart Chinese Patent Application No. 202110814025.5, 13 pages.

Office Action dated May 6, 2023 for counterpart Chinese Patent Application No. 202110814025.5, 8 pages.

Search report dated Aug. 21, 2022 for counterpart Chinese Patent Application No. 2021108140255, 4 pages.

International search report dated Jan. 17, 2022 for Chinese Patent Application No. PCT/CN2021/123138, 2 pages.

International search report dated Jan. 12, 2022 for counterpart Chinese Patent Application No. PCT/CN2021/123139, 2 pages.

Office Action dated Aug. 14, 2024 for counterpart Canadian Patent Application No. 3189150, 6 pages.

First Office Action and search report issued on Dec. 31, 2024 for counterpart Chinese Patent Application No. 202011358603.0, along with machine EN translation downloaded from EPO.

First Office Action and search report issued on Dec. 31, 2024 for counterpart Chinese Patent Application No. 202011358655.8, along with machine EN translation downloaded from EPO.

* cited by examiner

SHORT-RADIUS TRAJECTORY-CONTROLLABLE DRILLING TOOL AND COMBINED TYPE STEERABLE DRILLING TOOL

CROSS-REFERENCE TO RELATED APPLICATIONS

This application is the US national stage of International Patent Application No. PCT/CN2021/123139, filed on Oct. 11, 2021, which claims priority to Chinese Patent Application No. 202011358603.0, filed on Nov. 27, 2020 and entitled 'Short-radius Trajectory-controllable Drilling Tool'; to Chinese Patent Application No. 202010797032.4, filed on Aug. 10, 2020 and entitled 'Short-radius Trajectory-controllable Drilling Tool'; and to Chinese Patent Application No. 202110814025.5, filed on Jul. 19, 2021 and entitled 'Combined Type Steerable Drilling Tool and Method'. The disclosures of the foregoing applications are incorporated herein by reference in their entireties.

TECHNICAL FIELD

The present disclosure relates to the field of drilling technology, and in particular to a short-radius trajectory-controllable drilling tool and a combined type steerable drilling tool.

BACKGROUND

The reduction of production costs has always been a goal pursued in oil and gas drilling. With the development of unconventional oil and gas fields, the requirements for drilling equipment are getting higher and higher, and an automated, intelligent and efficient drilling technology has become the mainstream for reducing costs and improving efficiency. In addition, the drilling technology is also massively applied to the fields such as geological engineering and mineral exploitation.

At present, a Bottom Hole Assembly (BHA) of rotary drilling equipment generally controls the whipstocking performance of a drilling tool via the different position of centralizers or other changes in a BHA relationship, which can achieve a very low ultimate angle building hole rate of the directional well BHA for rotary drilling. A downhole tool that is available for well drilling in a rotating state relates to a rotary steering technology. The general whipstocking capacity of the Rotary Steerable System (RSS) is about 6°/30 m. The shortest radius orientation realized by Schlumberger, as the current most advanced international company, can only reach 15°/30 m, and cannot reach 18°/30 m even in a slim borehole. In the field of ultra-short-radius drilling, the radius of whipstocking curvature is generally required to be within a range of 10 m-60 m. In the field of extremely-short-radius drilling, the radius of whipstocking curvature of the extremely-short-radius drilling is required to be within a meter-level range of less than 10 meters. In this way, a reservoir can be well and accurately positioned, thus avoiding drilling operations in the mudstone, salt rock and other interlayers with complex geological conditions. In addition, the drilling of extended well sections of the above-mentioned ultra-short-radius well sections or extremely-short-radius well sections are completed via the ultra-short-radius well sections or the extremely-short-radius well sections. Because a drill string still needs to achieve large bending angle, it also belongs to the category of the above-mentioned ultra-short-radius well sections or the extremely-short-radius well sections.

The existing rotary steering system is inherently rigid and impossible to adapt to the actual needs of short-radius drilling, and its whipstocking capacity and ability to pass through a curved borehole have no precedent to achieve short-radius directional drilling with a turning radius of 10 m-60 m under rotary drilling conditions. Other related products also cannot realize the function of borehole trajectory control under rotary drilling conditions, resulting in a serious problem of applying weight on bit.

For the exploitation of many oil and gas reservoirs or solid mineral resources that require fluidized mining, drilling technologies and even horizontal well drilling technologies are required. Since the existing directional drilling technology cannot achieve short-radius steering, it is difficult to exploit ultra-thin reservoirs, or it is difficult to whipstock in caprock, but a directional well with large curvature steering is required after entering the reservoir, or branch drilling is implemented as much as possible, or wide-angle turns are realized in shallow stratums, or the utilization of reserves beside a well can be realized by sidetracking branch wells in the existing boreholes. In the prior art, screw drilling tools with bent joints are usually used to drill the branch wells to realize the utilization of reserves beside a well. The existing data shows that the existing directional drilling technology adopting the screw drilling tool and other directional drilling technologies cannot break through the angle building hole rate of 15°/30 m.

To sum up, the existing trajectory-controllable directional well technology cannot realize high curvature deflection. If the borehole curvature is too small, whipstocking sections will be too long, and well sections in a turning state will produce a great deal of invalid drilling footage. Therefore, the economic benefit is poor and the operation difficulty of construction well sections is increased. The steering performance and passing performance of other trajectory-controllable drilling tools cannot break through the limit of 18°/30 m, causing the same problems as the screw drilling tools detailed above.

SUMMARY

A purpose of the present disclosure is to provide a short-radius trajectory-controllable drilling tool, which has guiding properties and can realize short and ultra-short radius directional drilling or complete the directional drilling to the target via short and ultra-short radius boreholes, and further realizes high curvature deflection, and also to provide a combined type steerable drilling tool.

The purpose of the present disclosure can be realized by the following technical solution.

The present disclosure provides a short-radius trajectory-controllable drilling tool, including:

- a drill bit; and
- a controllable flexible weight on bit (WOB) & torque transmission drilling string, including a deflecting lever, an electrical actuator, and a plurality of load-bearing joints, wherein a lower end of the deflecting lever is fixedly connected to the drill bit; every two adjacent load-bearing joints are hinged by means of a deflectable WOB & torque transmission assembly, the lowermost load-bearing joint is a load-bearing body, and a steering actuator is disposed on the load-bearing body, a lower portion of the deflecting lever is hinged to a lower portion of the loading-bearing body by means of a controllable WOB & torque deflection transmission assembly, and a flexible interstice is formed between the deflecting lever and the load-bearing body; and the steering actuator is disposed in the flexible interstice and located above the controllable WOB & torque deflection transmission assembly, and the steering actuator is capable of driving the deflecting lever to swing around the controllable WOB & torque deflection transmission assembly and/or to rotate circumferentially about an axis of the load-bearing body.

The present disclosure provides a combined type steerable drilling tool, including a force transfer cylinder and a load-bearing body, wherein the load-bearing body is disposed inside the force transfer cylinder, and an upper portion of the load-bearing body is hinged to the force transfer cylinder by means of an inner hinge structure, or an upper portion of the force transfer cylinder is hinged to the load-bearing body by means of an inner hinge structure; and a drill bit is connected to a lower end of the load-bearing body, an annular activity space is provided between the force transfer cylinder and the load-bearing body, and a steering actuator is disposed in the annular activity space and is capable of driving the force transfer cylinder and the load-bearing body to move relative to each other.

The present disclosure has the following characteristics and advantages.

First, according to the short-radius trajectory-controllable drilling tool provided by the present disclosure, the every two adjacent load-bearing joints are hinged by means of the deflectable WOB & torque transmission assembly so as to form a controllable flexible WOB & torque transmission drilling string, which realizes the engineering feasibility and practical value of a short-radius directional drilling technology for thin reservoir exploitation, enhanced oil recovery, sub-salt reservoir exploitation, combined exploitation of thin interbed, heavy oil coalbed methane exploitation, and exploitation of soft or even liquid solid minerals such as hydrates, and further achieves high curvature deflection; and the steering actuator can drive an axis of the drill bit to controllably deviate from the axis of the load-bearing body via the deflecting lever, thus realizing a guiding function.

Second, since the deflectable WOB & torque transmission assembly disposed behind the drill bit will transmit a large interference force to the drill bit and thus interfere with the guiding direction, and in softer stratums, this interference force is inevitable, which will cause a centralizer disposed at a pup joint to be unable to form a support together with a hole-wall, and will further lead to the instability of steering. According to the short-radius trajectory-controllable drilling tool provided by the present disclosure, due to the arrangement of a bit, at least two point of the articulated sleeve can be in contact with the hole-wall, thus achieving the purpose of improving the guiding stability.

Third, an upper drill string will transmit weight on bit and torque downward along the controllable flexible WOB & torque transmission drilling string. In this process, all the load-bearing joints in the controllable flexible WOB & torque transmission drilling string will be subjected to helical buckling and shaking, which in turn causes the instability of transmission directions of the weight on bit and the torque, and thus easily causes the load-bearing body provided with the guiding assembly to be affected by an interference force. According to the present disclosure, due to the arrangement of an isolation centralizer, the influence of the above interference is effectively avoided.

Fourth, the present disclosure adopts hydraulic pressure to push the articulated sleeve to deflect, which has good adaptability to bending boreholes. The electrical actuator applies a thrust to pistons only by controlling the connectivity between the driving hydraulic cylinder and a flow channel without limiting their displacement. Therefore, even when the controllable flexible WOB & torque transmission drilling string vibrates violently, passes through a high-curvature borehole or encounters borehole enlargement, the pistons can adapt to the passive displacement change under the action of an external force, which can avoid the phenomenon that the short-radius trajectory-controllable drilling tool encounters obstructions in the borehole.

Fifth, the combined type steerable drilling tool provided by the present disclosure can realize directional drilling of a short-radius drill string under rotating conditions by the drive drill string, which effectively solves the problem of borehole extension of short-extremely short radius wells, and realizes the engineering feasibility and practical value of the short-radius directional drilling technology for combined exploitation of oil and gas resources in multiple series of strata, thin hydrocarbon reservoir exploitation, residual oil digging potential, coalbed methane exploitation, and exploitation of other minerals. The combined type steerable drilling tool provided by the present disclosure can prevent the situation that the hole-wall is damaged by an impact force caused by the strenuous vibration produced by the drive drill string in the borehole.

BRIEF DESCRIPTION OF THE DRAWINGS

The following accompanying drawings are only intended to schematically illustrate and explain the present disclosure, and do not limit the scope of the present disclosure. In the drawings.

DETAILED DESCRIPTION

For a clearer understanding of the technical features, objectives and effects of the present disclosure, specific embodiments of the present disclosure will now be illustrated with reference to the accompanying drawings. In the description of the present disclosure, unless otherwise stated, 'a plurality of' means two or more.

Figure 1:
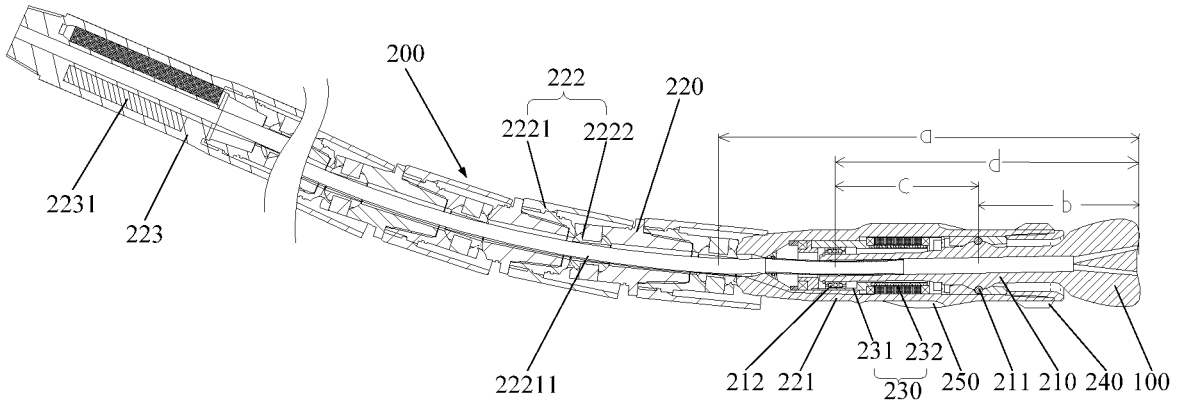
FIG. 1 is a schematic diagram of the structure of a short-radius trajectory-controllable drilling tool according to a first embodiment of the present disclosure.
Figure 2:
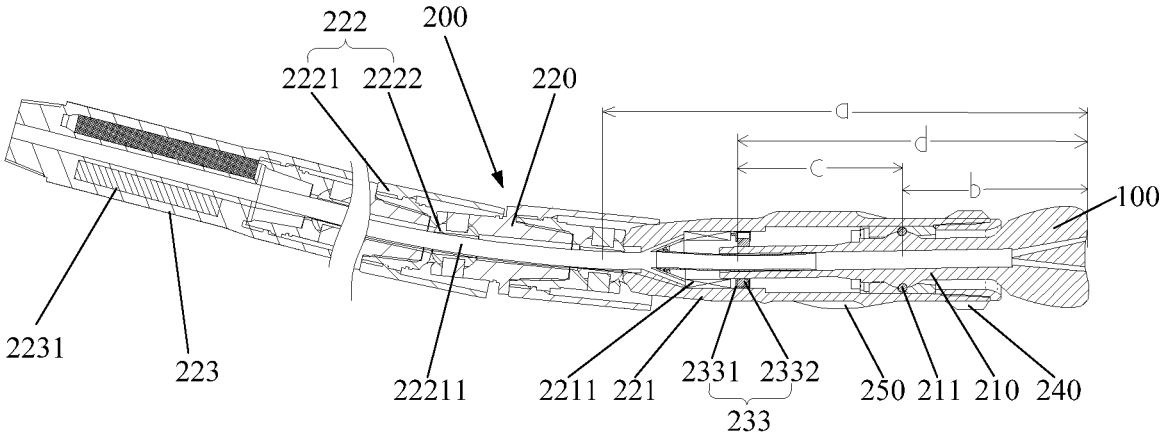
FIG. 2 is a schematic diagram of the structure of a short-radius trajectory-controllable drilling tool according to a second embodiment of the present disclosure.
Figure 3:
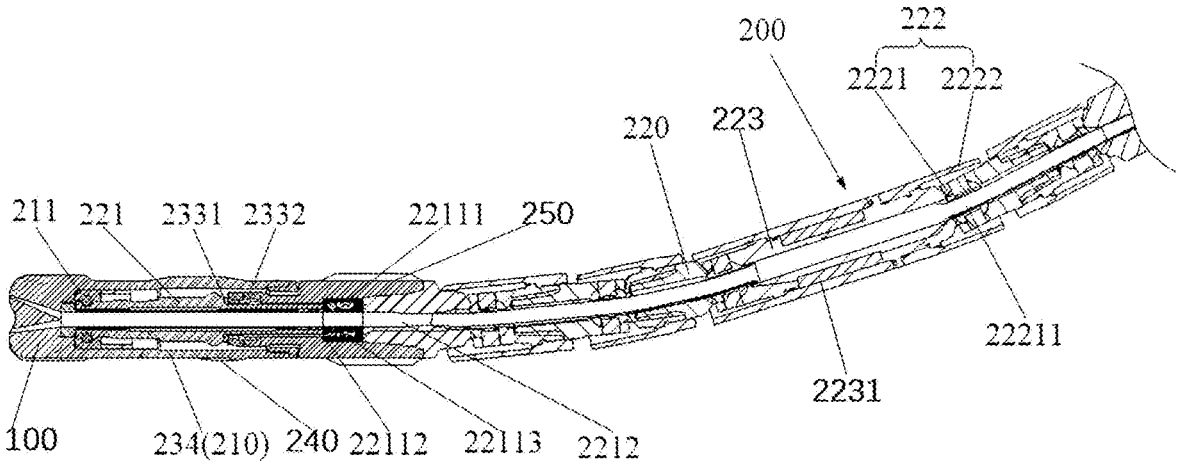
FIG. 3 is a schematic diagram of the structure of a short-radius trajectory-controllable drilling tool according to a third embodiment of the present disclosure.

As shown in FIG. 1, FIG. 2 and FIG. 3, the present disclosure provides a short-radius trajectory-controllable drilling tool, which includes a drill bit 100 and a controllable flexible WOB & (i.e., and) torque transmission drilling string 200.

The drill bit 100 may be a drill bit 100 which breaks a stratum by cutting and/or jet flow action. When the drill bit 100 is a drill bit 100 which breaks the stratum by or partially by the jet flow action, a solid phase contained in a jet flow will be sprayed along the direction of a built-in nozzle of the drill bit 100 along with the jet flow.

The controllable flexible WOB & torque transmission drilling string 200 can drive the drill bit 100 to complete the short-extremely short radius borehole drilling or complete the drilling of extended well sections of short-extremely short radius well sections via the short-extremely short radius well sections.

The controllable flexible WOB & torque transmission drilling string 200 includes a deflecting lever 210 and a plurality of load-bearing joints 220. A lower end of the deflecting lever 210 is fixedly connected to the drill bit 100. The drill bit 100 may move along with the deflecting lever 210. Every two adjacent load-bearing joints 220 are hinged by means of a deflectable WOB & torque transmission assembly 222 to realize the large deflection of the short-radius trajectory-controllable drilling tool and the power transmission of rotary drilling. The lowermost load-bearing joint 220 is a load-bearing body 221. A steering actuator 230 is disposed on the load-bearing body 221. The deflecting lever 210 may be sleeved over the load-bearing body 221. The deflecting lever 210 may also penetrate through the load-bearing body 221. A lower portion of the deflecting lever 210 is hinged to a lower portion of the load-bearing body 221 by means of a controllable WOB & torque deflection transmission assembly 211. A flexible interstice is formed between the deflecting lever 210 and the load-bearing body 221. Thus the deflecting lever 210 can deflect at a preset angle relative to the load-bearing body 221. The steering actuator 230 is disposed in the flexible interstice and located above the controllable WOB & torque deflection transmission assembly 211. The steering actuator 230 can drive the deflecting lever 210 to swing around the controllable WOB & torque deflection transmission assembly 211 and/or to rotate circumferentially about an axis of the load-bearing body 221, that is, the steering actuator 230 can drive the deflecting lever 210 to drive the drill bit 100 to deflect at an angle relative to the load-bearing body 221 so as to achieve the purpose of changing the borehole trajectory. Furthermore, the steering actuator 230 is controlled by an external measurement and control system, so as to control the borehole trajectory.

It should be noted that the fixed connection may be any connection mode that can transfer drilling power, including welding, integrated processing and screwed connection.

The controllable flexible WOB & torque transmission drilling string 200 is obviously different from a flexible joint in the prior art. The flexible joint in the prior art is only a drill pipe with a smaller diameter. Because the flexible joint has to bear tensile stress, WOB transmission and torque transmission, the diameter and cross-sectional area of the flexible joint are greatly limited. Therefore, the flexible joint is far from being able to achieve short-radius drilling while maintaining the basic safety of completely drilling.

The short-radius trajectory-controllable drilling tool needs to use rotating power sources such as a drilling rig turntable, a drilling rig top drive, a drill string, and a power motor to provide power for rotary drilling.

According to the short-radius trajectory-controllable drilling tool provided by the present disclosure, the every two adjacent load-bearing joints 220 are hinged by means of the deflectable WOB & torque transmission assembly 222 so as to form the controllable flexible WOB & torque transmission drilling string 200, which realizes the engineering feasibility and practical value of a short-radius directional drilling technology for thin reservoir exploitation, residual oil digging potential, exploitation of horizontal wells in sub-salt reservoirs, combined exploitation of multiple series of strata, coalbed methane exploitation, and exploitation of soft or even liquid solid minerals such as hydrates, and further achieves high curvature deflection. The steering actuator can drive an axis of the drill bit 100 to controllably deviate from the axis of the load-bearing body 221 via the deflecting lever 210, thus realizing a guiding function.

Further, as shown in FIG. 1, the controllable flexible WOB & torque transmission drilling string 200 further includes a first centralizer 240 and a second centralizer 250. The first centralizer 240 is disposed between a lower end of the steering actuator 230 and the drill bit 100 and located at an outer side of the load-bearing body 221. Alternatively, the first centralizer 240 is disposed between the lower end of the steering actuator 230 and the drill bit 100 and located at an outer side of the deflecting lever 210. The second centralizer 250 is disposed adjacent to the first deflectable WOB & torque transmission assembly 222 above the load-bearing body 221. The first centralizer 240 and the second centralizer 250 can ensure that the controllable flexible WOB & torque transmission drilling string 200 and the borehole are always coaxial.

Still further, the first centralizer 240 is a reaming bit. The reaming bit includes a gauge protection structure. Specifically, the reaming bit consists of 3-8 blade wings inlaid with PDC teeth, which are used to expand and smooth a borehole behind the drill bit. The axial length of the gauge protection structure is 0.5 inches to 10 inches. It should be noted that in a drilling process, both the drill bit and the reaming bit are cutting rocks and are at the center of the borehole, so that the arrangement of the reaming bit improves the stratum adaptability and stability of the short-radius trajectory-controllable drilling tool, and avoids the situation that the first centralizer cannot support a hole-wall due to borehole enlargement.

Further, an isolation centralizer is sleeved over the load-bearing joint 220 adjacent to the load-bearing body 221. The distance between the isolation centralizer and an upper end of the load-bearing body 221 is not more than 10 times the diameter of a borehole. The isolation centralizer can isolate the disturbing force transmitted from top to bottom.

Further, as shown in FIG. 1, FIG. 2 and FIG. 3, the length of an upper moment arm of the deflecting lever 210 is at least 30% of a distance between the controllable WOB & torque deflection transmission assembly 211 and the deflectable WOB & torque transmission assembly 222 disposed above and adjacent to the controllable WOB & torque deflection transmission assembly, so as to make full use of the space of the load-bearing body 221 to extend the upper moment arm, so that the drill bit 100 can obtain as much guiding force as possible.

A length of a lower moment arm of the deflecting lever 210 is less than 50% of a distance between the controllable WOB & torque deflection transmission assembly 211 and the deflectable WOB & torque transmission assembly 222 disposed above and adjacent to the controllable WOB & torque deflection transmission assembly, so as to minimize the interference caused by the torque or vibration of the drill bit 100 to the deflecting lever 210, so that the stability of the steering process is maximized.

It should be noted that the length c of the upper moment arm of the deflecting lever 210 is a distance from the controllable WOB & torque deflection transmission assembly 211 to a force application point by the steering actuator 230 to the deflecting lever 210, and the length b of the lower moment arm of the deflecting lever is a distance from a lower end face of the drill bit 100 to the controllable WOB & torque deflection transmission assembly 211.

Further, a distance d between the steering actuator 230 and the lower end of the drill bit 100 is at least 50% of a distance a between a lower end of the drill bit 100 and the deflectable WOB & torque transmission assembly 222 disposed above and adjacent to the drill bit, so that the load-bearing body 221 can apply a sufficient lateral force to the drill bit 100.

Further, a deflection angle of the deflectable WOB & torque transmission assembly 222 is 0°-15°, so as to limit the deflection angle between the two adjacent load-bearing joints 220 to be within a range of 0°-15°, thereby achieving high curvature deflection.

Still further, as shown in FIG. 1 to FIG. 3, each of the deflectable WOB & torque transmission assemblies 222 includes a transmission universal joint 2221 and a bearing sleeve 2222 sleeved over the transmission universal joint 2221. The two adjacent load-bearing joints 220 are respectively connected to an input end and an output end of the corresponding transmission universal joint 2221. The output end and the input end of each of the transmission universal joints 2221 are defined according to the power transmission direction. There is an interstice between the bearing sleeve 2222 and the transmission universal joint 2221 to form a deflection space, and the transmission universal joint 2221 can deflect at an angle of 0°-15° in the deflection space relative to an axis of the bearing sleeve 2222. The deflection angle of the transmission universal joint 2221 is limited by the bearing sleeve 2222, which can prevent the deflectable WOB & torque transmission assembly's 222 from hindering the transmission of a WOB & torque due to being excessively buckled in a WOB & torque transmission process, so that the WOB & torque can be transmitted smoothly.

It should be noted that the structure of the controllable WOB & torque deflection transmission assembly 211 may be the same as that of the deflectable WOB & torque transmission assemblies 222, or the controllable WOB & torque deflection transmission assembly 211 may only include a transmission universal joint 2221, or the controllable WOB & torque deflection transmission assembly 211 may be a combination of a spherical hinge and a torque transmission structure.

Further, each load-bearing joint 220 is provided with a through structure 22211 along the axial direction. The through structures 22211 form a main flow channel 2212 for the circulation of a drilling circulating medium or a structure for accommodating the flow of drilling fluid. A flow tube is fixed in the load-bearing body 221 along the axial direction, and is used to provide a flow channel for the drilling fluid. An outlet of the flow tube is located below the controllable WOB & torque deflection transmission assembly 211 and is in fluid communication with the drill bit 100. An inlet of the flow tube is provided above the controllable WOB & torque deflection transmission assembly 211, and is in fluid communication with the through structures 22211.

Embodiment I

As shown in FIG. 1, the deflecting lever 210 is inserted inside the load-bearing body 221. The steering actuator 230 includes an eccentric ring 231. The load-bearing body 221 is provided with an electrical actuator 2211. The electrical actuator 2211 is a drive motor 232. The drive motor 232 is sleeved over the deflecting lever 210 in an encircled manner. The eccentric ring 231 is disposed above the drive motor 232 and is coupled to a rotor output end of the drive motor 232. The drive motor 232 can drive the eccentric ring 231 to rotate. A bearing 212 is disposed between the eccentric ring 231 and the deflecting lever 210. The deflecting lever 210 can be driven to swing around the controllable WOB & torque deflection transmission assembly 211 and/or to rotate circumferentially about the axis of the load-bearing body 221 by means of the rotation of the eccentric ring 231. Specifically, the direction of rotation of a rear end of the deflecting lever 210 driven by the eccentric ring 231 around the axis of the load-bearing body 221 is opposite to that of the drill bit 100 driven by the short-radius trajectory-controllable drilling tool. That is, the eccentric ring 231 drives the deflecting lever 210 to deflect towards a guiding direction relative to the load-bearing body 221 and is stationary to the ground when guiding to a specific direction. The speed of revolution of the rear end of the deflecting lever 210 driven by the eccentric ring 231 around the axis of the load-bearing body 221 is the same as the rotation speed of the drill bit 100 driven by the short-radius trajectory-controllable drilling tool, so that the deflecting lever 210 can drive the drill bit 100 to deflect toward a preset direction in a guiding manner.

It should be noted that since the steering actuator cannot directly apply a reaction force to the hole-wall while applying a lateral force to the drill bit 100, the eccentric ring 231 can improve the structural rigidity among the load-bearing body 221, the deflecting lever 210, the steering actuator 230 and the transmission universal joints 2221, which facilitates the improvement of the stability of the steerable drilling, and plays a better role in restraining and isolating the disturbance caused by the controllable flexible WOB & torque transmission drilling string 200.

Embodiment II

As shown in FIG. 2, the deflecting lever 210 is inserted inside the load-bearing body 221. The load-bearing body 221 is provided with an electrical actuator 2211. The electrical actuator 2211 includes solenoid valves 22111. The steering actuator 230 includes at least three groups of driving hydraulic cylinders 233 disposed along the radial direction of the load-bearing body 221, and the driving hydraulic cylinders 233 are disposed at intervals. Each of the driving hydraulic cylinders 233 includes a cylinder 2331 connected to a side wall of the load-bearing body 221, and a piston 2332 disposed in the cylinder 2331. Each piston 2332 is connected to a pushing support piece. The solenoid valves 22111 can periodically drive the pistons 2332 to move along the radial direction of the load-bearing body 221. The pistons 2332 can periodically drive the pushing support piece to move along the radial direction of the load-bearing body 221. The deflecting lever 210 can be driven to rotate around the controllable WOB & torque deflection transmission assembly 211 by means of the movement of the pushing support piece. Specifically, the movement of the pushing support piece can push the deflecting lever 210 in an abutting manner, so that the deflecting lever 210 is allowed to rotate around the controllable WOB & torque deflection transmission assembly 211, and the drill bit 100 is drive to steer towards a preset direction.

It should be noted that the arrangement of the pushing support piece is to ensure the stability of force transmission. In actual use, the pushing support piece may not be disposed.

Embodiment III

Figure 4:
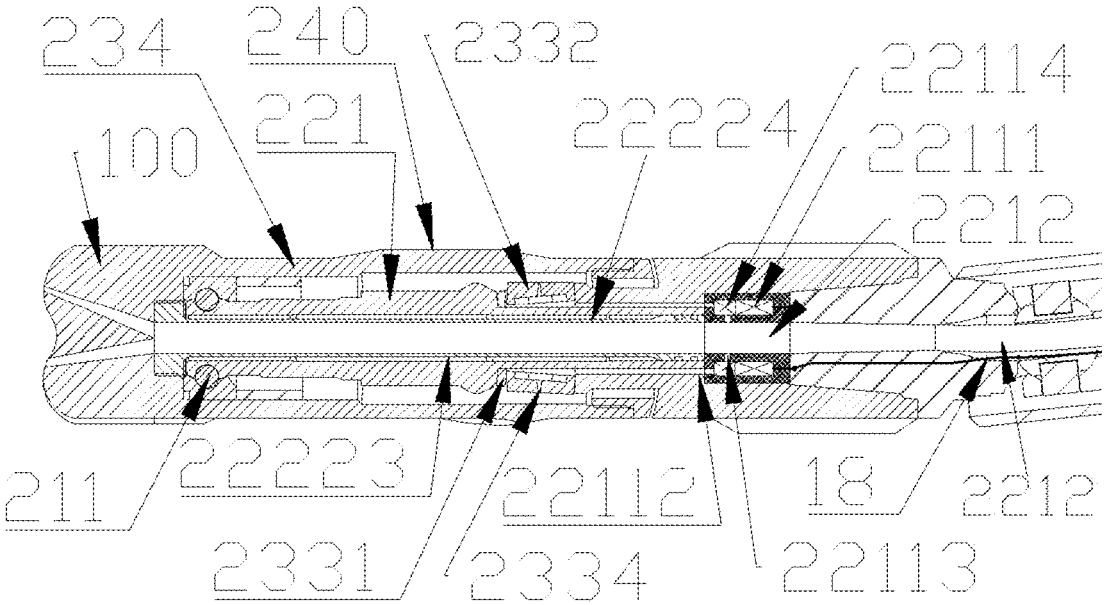
FIG. 4 is a schematic diagram of a partial enlarged structure of FIG. 3.

As shown in FIG. 3 and FIG. 4, the deflecting lever 210 is an articulated sleeve 234. The steering actuator 230 is connected to an internal surface of the load-bearing body 221. The steering actuator 230 includes at least three groups of driving hydraulic cylinders 233 disposed along the radial direction of the load-bearing body 221, and the driving hydraulic cylinders 233 are disposed at intervals. Each of the driving hydraulic cylinders 233 includes a cylinder 2331 connected to the side wall of the load-bearing body 221, and a piston 2332 disposed in the cylinder 2331. The pistons 2332 can be abutted against an inner wall of the articulated sleeve 234. The load-bearing body 221 is also provided with an electrical actuator 2211. The load-bearing body 221 is internally provided with a flow channel 2212. The electrical actuator 2211 includes a plurality of solenoid valves 22111 corresponding to the driving hydraulic cylinders 233 on a one-to-one basis. Each of the solenoid valves 22111 has a first path 22112 and a second path 22113. The first paths 22112 are in fluid communication with the driving hydraulic cylinders 233. The second paths 22113 are in fluid communication with the flow channel 2212. The solenoid valves 22111 can enable the flow channel 2212 to be periodically in fluid communication with the driving hydraulic cylinders 233. Specifically, the solenoid valves 22111 are two-position two-way solenoid reversing valves, each of which includes a two-position two-way valve body 22114. The first paths 22112 and the second paths 22113 are formed in the two-position two-way valve bodies 22114. The two-position two-way valve bodies mainly refer to the valve bodies that can be controlled by an electromagnet or an equivalent alternative electric control assembly, and can realize two valve position states of valve opening and closing, so as to realize a fluid communication between the first paths and the second paths, and further control the fluid communication between the flow channel and the driving hydraulic cylinders. In the embodiment, electromagnetic commutation is used to realize the function of the two-position two-way valves, but any other equivalent substitution is not excluded. For example, using an electric motor or other electrical actuators to drive the two-position two-way valves belongs to an equivalent substitution. In addition, the present disclosure focuses on protecting a mechanical structure formed by the deflecting lever, the load-bearing body, the load-bearing joints and the deflectable WOB & torque transmission assembly. The specific driving modes can be equally substituted, and all such substitutions fall within the protection scope of the present disclosure as long as they can realize the periodic fluid supply for each driving hydraulic cylinder.

Further, one load-bearing joint 220 located above the load-bearing body 221 is a drive control joint 223. The drive control joint 223 is internally provided with an electrical actuator drive control circuit 2231. The electrical actuator drive control circuit 2231 is electrically connected to the electrical actuator 2211. The solenoid valves 22111 can periodically open/close the connection between the first paths 22112 and the second paths 22113 under the control of the electrical actuator drive control circuit 2231, so that the driving hydraulic cylinders 233 periodically contact the high-pressure fluid in the flow channel 2212 inside the load-bearing body 221 and generate a thrust. In addition, due to the arrangement of the drive control joint 223, it is suitable for accommodating the electrical actuator drive control circuit with larger space requirement and higher heat dissipation requirement, which is beneficial to minimize the lengths of all the load-bearing bodies 221, and improves the pass ability of the short-radius drilling tool. Furthermore, since the electrical actuator drive control circuit includes electronic components with larger volumes and higher heat dissipation requirement such as a switch tube and a switch tube driver, the electrical actuator drive control circuit is rear-mounted, which is beneficial to the shock absorption of the electrical actuator drive control circuit.

Further, a distance from a deflection point of the controllable WOB & torque deflection transmission assembly 211 to the upper end of the articulated sleeve 234 is greater than 30% of a distance from the deflection point of the controllable WOB & torque deflection transmission assembly 211 to a deflection point of the deflectable WOB & torque transmission assembly 222 located at the lowermost end. The distance from the deflection point of the controllable WOB & torque deflection transmission assembly 211 to the upper end of the articulated sleeve 234 is greater than 40% of a distance from the deflection point of the controllable WOB & torque deflection transmission assembly 211 to the second centralizer 250. The length of the distance from the lower end of the drill bit 100 to the deflection point of the controllable WOB & torque deflection transmission assembly 211 is set to 5-50% of the distance from the deflection point of the controllable WOB & torque deflection transmission assembly 211 to the deflection point of the deflectable WOB & torque transmission assembly 222 located at the lowermost end. In this way, by setting the ratios of the moment arms, the present disclosure has the advantage that the thrust of the steering actuator 230 is allowed to act on the drill bit 100 and the first centralizer 240 as much as possible, without being disturbed by the swing of the deflectable WOB & torque transmission assembly 222 located behind the steering actuator 230.

Figure 7:
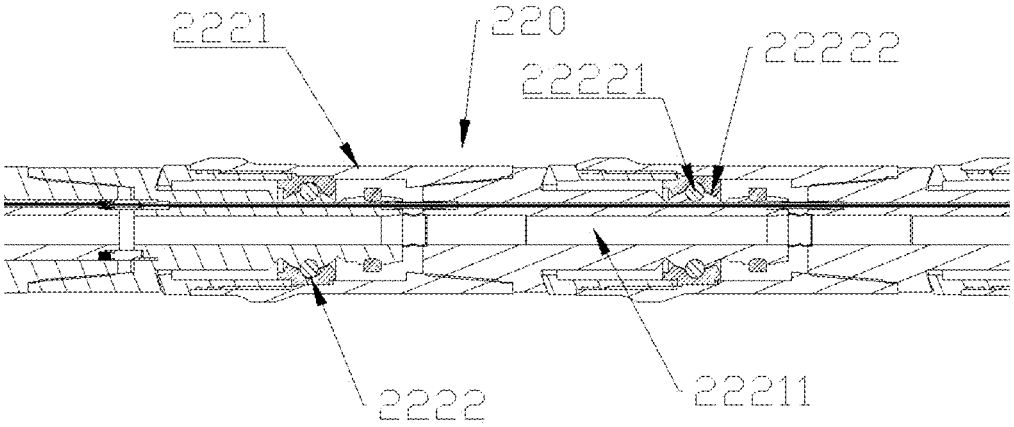
FIG. 7 is a schematic diagram of a short-radius trajectory-controllable drilling tool of the present disclosure in use.
Figure 8:
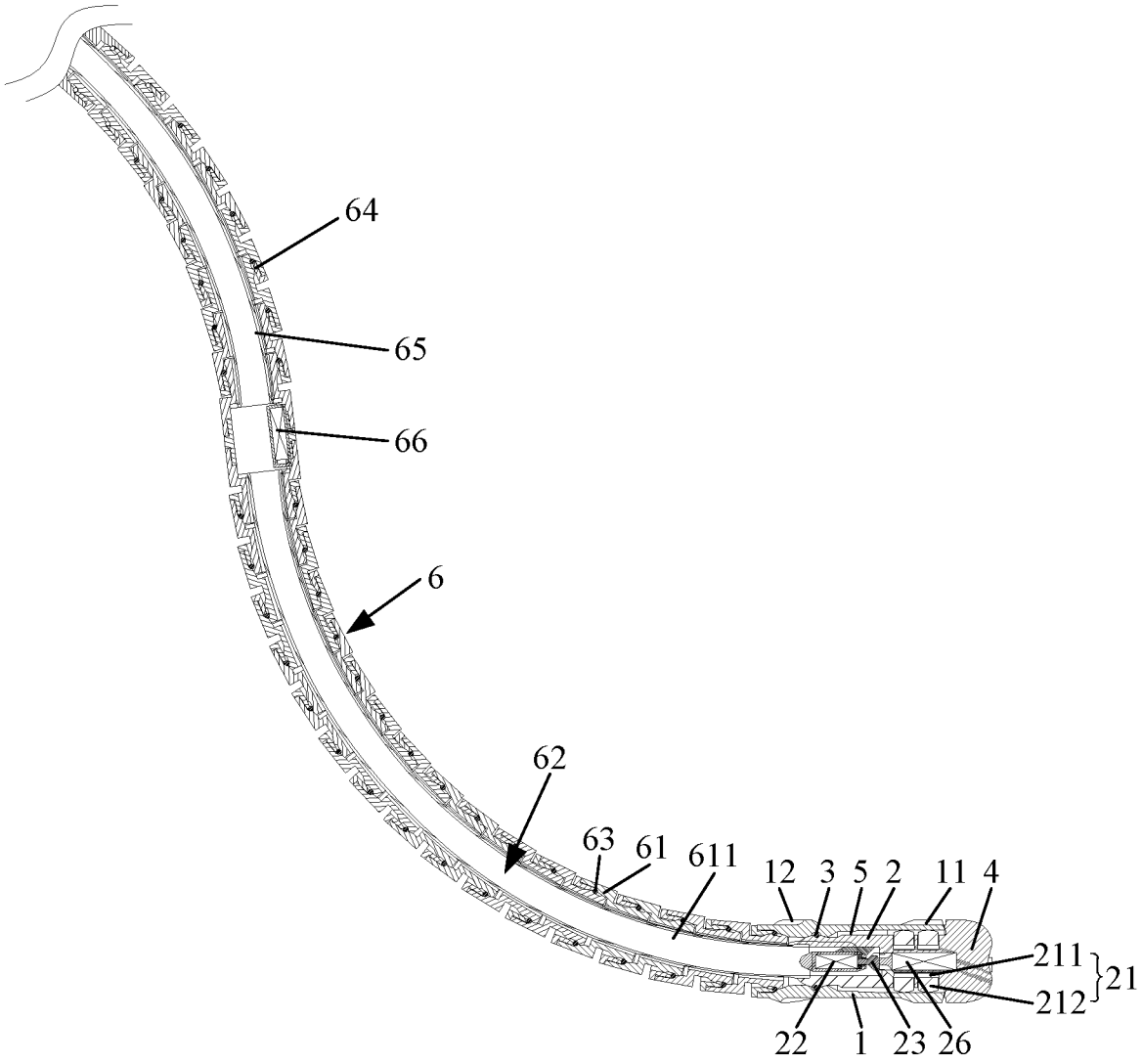
FIG. 8 is a schematic diagram of the structure of a combined type steerable drilling tool of the present disclosure.

Exemplarily, the transmission universal joints 2221 are cross-axis universal joints or articulated ball cage type transmission universal joints. As shown in FIG. 7, the articulated ball cage type transmission universal joints are specifically a combination of torque transmission ball cages 22221 and hinge structures 22222. Specifically, the torque transmission ball cages 22221 are used to transmit a torque. When the torque transmission ball cages 22221 rotate under the action of the torque, the torque is transmitted to the articulated sleeve via the torque transmission ball cage to further drive the drill bit to rotate. The hinge structures 22222 are used to transmit an axial force. The torque transmission ball cages 22221 and the hinge structures 22222 together constitute the deflectable WOB & torque transmission assembly 222 that can transmit the axial force. In the processes of rotating and steering, the deflectable WOB & torque transmission assembly 222 directly transmits the upper weight on bit to the drill bit 100 or transmits the upper weight on bit to the drill bit 100 via the articulated sleeve 234. In order to provide deflection spaces required for the articulated sleeve 234 deflecting around the torque transmission ball cages 22221 during steerable drilling, an upper end of the articulated sleeve 234 is provided with articulated sleeve limit ends 22223, and a flexible interstice is provided between each articulated sleeve limit end 22223 and an outer surface of the load-bearing body 221. In addition, the articulated sleeve 234 is provided with a draft tube 22224 as a drilling fluid channel to ensure that the drilling fluid flows from a flexible pressure-bearing flow tube through a central water hole of the load-bearing body, further flows to the drill bit 100 through the draft tube 22224, and is finally discharged to an annular space through the water hole.

Embodiment IV

Figure 5:
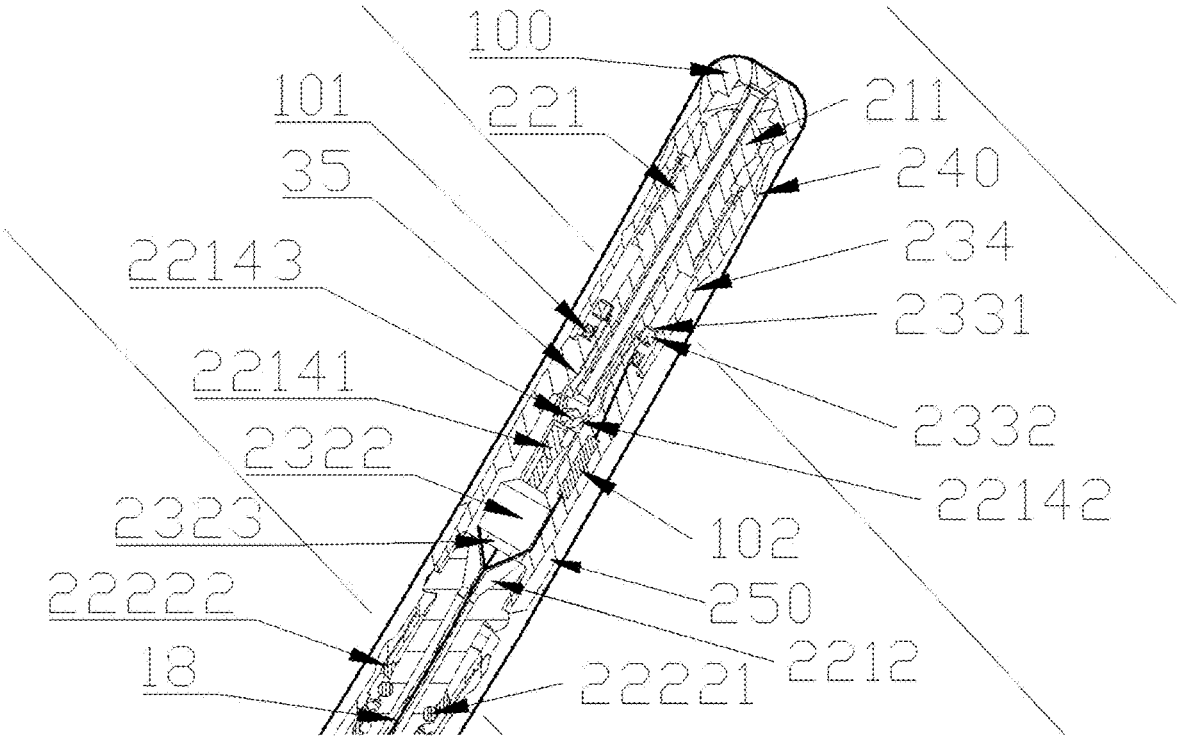
FIG. 5 is a partial schematic diagram of the structure of a short-radius trajectory-controllable drilling tool according to a fourth embodiment of the present disclosure.

As shown in FIG. 5, the deflecting lever 210 is a articulated sleeve 234. The steering actuator 230 is connected to the internal surface of the load-bearing body 221. The steering actuator 230 includes at least three groups of driving hydraulic cylinders 233 disposed along the radial direction of the load-bearing body 221, and the driving hydraulic cylinders 233 are disposed at intervals. Each of the driving hydraulic cylinders 233 includes a cylinder 2331 connected to the side wall of the load-bearing body 221 and a piston 2332 disposed in the cylinder 2331. The pistons 2332 can be abutted against the inner wall of the articulated sleeve 234. The load-bearing body 221 is internally provided with a flow channel 2212. The load-bearing body 221 is also provided with an electrical actuator 2211. The electrical actuator includes a rotary valve drive motor 2322 and a rotary valve. The rotary valve includes a rotary valve disc 22141 and a rotary valve seat 22142. The rotary valve seat 22142 is internally provided with a plurality of holes corresponding to the driving hydraulic cylinders 233 on a one-to-one basis. The rotary valve is provided with an opening. The rotary valve drive motor 2322 is capable of driving the rotary valve to rotate to make the opening face a specific direction, so that the holes on the rotary valve seat in the direction of the opening are in fluid communication with the flow channel 2212, and finally the flow channel 2212 is periodically in fluid communication with the driving hydraulic cylinders 233 to realize fluid supply to the driving hydraulic cylinders 233 in a specific direction, thus achieving the purpose of steering. It should be added that the pistons given in Example III and Example IV can realize both steering and angle holding functions. When steering is required, the electrical actuator controls high-pressure fluid in the flow channel 2212 to flow into a high-pressure piston drainage tube 35 corresponding to the pistons in sectors opposite to a preset guiding direction, so that the pistons 2332 in the sectors opposite to the preset guiding direction are driven to drive the articulated sleeve 234 to deflect around the transmission universal joints 2221, and the drill bit is further deflected to the preset guiding direction. With the deepening of drilling footage, the short-radius trajectory-controllable drilling tool is gradually adjusted to a position with hole deviation and azimuth which need to be steered. When stable drilling is required, the electrical actuator will alternately push out the uniformly distributed pistons 2332, so that the pistons 2332 will continuously act on the articulated sleeve 234 in the circumferential direction of 360°, and the drill bit will swing in the circumferential direction of 360° to achieve the purpose of angle-holding drilling. In addition, due to the complex working conditions faced by the drilling tool, the orientation of any 'direction' or 'sector' described in the present disclosure only represents a high probability of orientation of a certain 'direction' or 'sector'.

It should be noted that the rotary valve drive motor 2322 can also drive the rotary valve to rotate, so that a drainage channel 22143 is selectively brought into and out of fluid communication with the driving hydraulic cylinders 233 periodically along with the rotation of the short-radius trajectory-controllable drilling tool, so as to assist the discharging of spent liquid in the driving hydraulic cylinders 233 into the annular space. The closed state mainly refers to a state, in which the connectivity is deteriorated. It does not specifically mean that the connected state is absolutely cut off. The obvious deterioration of the connectivity is also a closed state, in which the specific structure and function of the rotary valve disc 22141 and the rotary valve seat 22142 to open and close the flow channel belong to the prior art, and will not be repeated here.

In addition, the fluid in the driving hydraulic cylinders 233 may also be discharged in real time by means of throttle valves 2334 while controlling liquid discharge by using the rotary valve. When the rotary valve drive motor 2322 drives the rotary valve to supply fluid to the driving hydraulic cylinders 233 in the sectors facing away from the guiding direction, the fluid supply amount is greater than the liquid discharge amount of the throttle valves 2334, so the driving hydraulic cylinders 233 push and abut against the articulated sleeve 234. When the rotary valve drive motor 2322 drives the rotary valve not to supply fluid to the driving hydraulic cylinders 233 in the sectors facing away from the guiding direction, the fluid supply amount is less than the liquid discharge amount of the throttle valves 2334, so the driving hydraulic cylinders 233 are squeezed and recovered by the inner wall of the articulated sleeve 234.

Further, cylinders 2331 are coupled to the electrical actuator 2211 (rotary valve drive motor 2322) via the high-pressure piston drainage tube 35. An electrical cable 18 is fixedly disposed inside the controllable flexible WOB & torque transmission drilling string and rotates along with the controllable flexible WOB & torque transmission drilling string 200. The electrical cable 18 can provide power and communication for the electrical actuator 2211 and the steering actuator 230.

Further, the load-bearing body 221 is further provided with a measurement module 102 and a control circuit. The second centralizer 250 is disposed on an outer surface of the load-bearing body 221. A first centralizer 240 is provided on an outer surface of the articulated sleeve 234. The measurement module is configured to measure a tool face angle of the short-radius trajectory-controllable drilling tool, and transmit the same to the control circuit. The control circuit is configured to drive the electrical actuator 2211 to achieve steering. The specific process is the prior art, which will not be repeated here. A rotary transformer 2323, which is coaxially connected to the rotary valve drive motor 2322, is also electrically connected to the control circuit, and is configured to receive the angular position information fed back by the rotary valve drive motor 2322, so as to control the angular position of the rotary valve. The specific process is the prior art, which will not be repeated here.

Still further, the measurement module 102 is an attitude measurement sensor, which is used to measure a gravity toolface angle or a magnetic toolface angle. Specifically, the attitude measurement sensor is a strap-down measurement system, which may measure the attitude parameters of the short-radius trajectory-controllable drilling tool without relying on an inertial platform and external information. The control circuit is configured to control the electrical actuator to execute command actions according to the measured gravity toolface angle and/or magnetic toolface angle so as to further drive the steering actuator to drive the drill bit to deflect in the guiding direction. The steering actuator, the attitude measurement sensor, the electrical actuator and the control circuit rotate together with the short-radius trajectory-controllable drilling tool.

Further, the load-bearing body 221 is also provided with displacement sensors 101. The displacement sensors 101 are located in a interstice between the deflecting lever 210 and the load-bearing body 211. The displacement sensors 101 are is configured to measure the relative motion of the deflecting lever 210 and the load-bearing body 221. The control circuit is electrically connected to the attitude measurement sensor and the displacement sensors, so as to obtain the displacement data fed back by the displacement sensors in all the sectors during the rotation of the short-radius trajectory-controllable drilling tool, and calculate, according to the displacement data, the deflection direction of the deflecting lever relative to the load-bearing body.

Embodiment V

Figure 6:
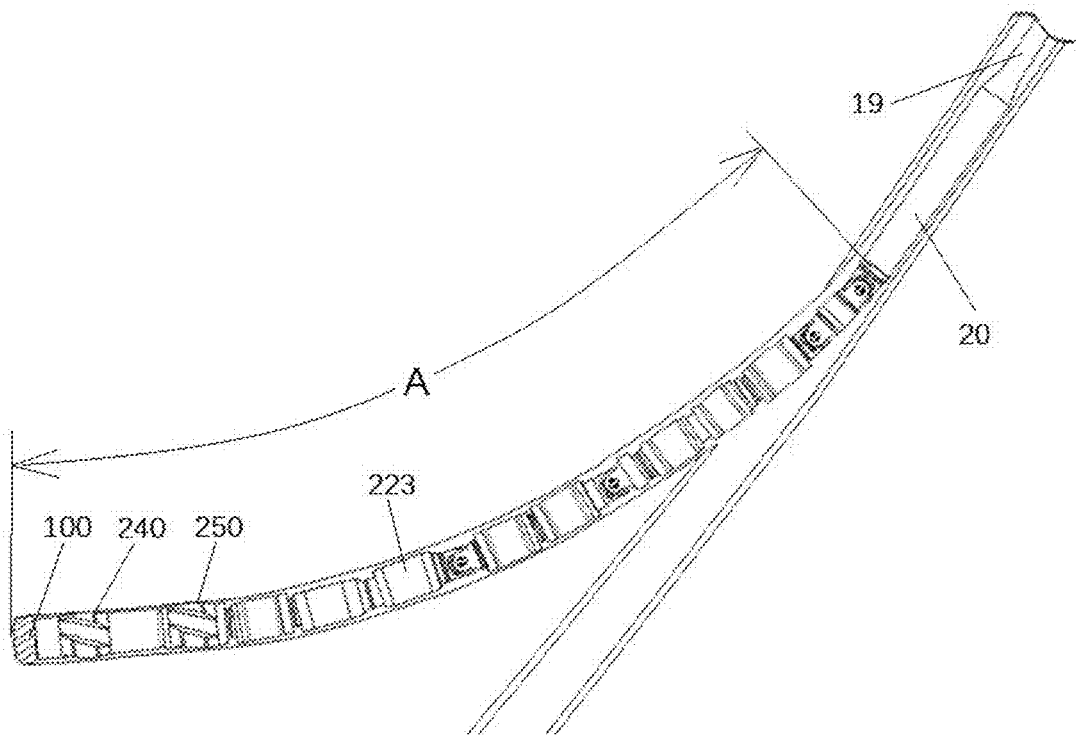
FIG. 6 is a schematic diagram of the structure of articulated ball cage type transmission universal joints.

As shown in FIG. 6, the short-radius trajectory-controllable drilling tool may be driven by the drill pipe 19 to achieve long-distance drilling power transmission. Different from the above Examples, this Example mainly focuses on application of sidetracking branch wells in deep wells. Therefore, the short-radius trajectory-controllable drilling tool in this Example is an implementation including the drill pipe 19. The drill bit 100 and the controllable flexible WOB & torque transmission drilling string are driven by the drill pipe 19 with higher rigidity, thus ensuring that the short-radius trajectory-controllable drilling tool obtains stable rotation speed and weight on bit at a bottom hole. It should be noted that the section shown in A of FIG. 6 is the controllable flexible WOB & torque transmission drilling string, which is used to complete the drilling of short-extremely short radius well sections or the drilling of extended boreholes of the short-extremely short radius well sections through the short-extremely short radius well sections. Under such conditions, the drill pipe 19 can stably transmit drilling power and/or bear torque in a main borehole.

The drill pipe 19 is in a transmission connection with the drill bit 100 by means of the controllable flexible WOB & torque transmission drilling string 200, so that the drill pipe 19 can transmit rotational power to the drill bit 100 by means of the controllable flexible WOB & torque transmission drilling string 200.

The short-radius trajectory-controllable drilling tool described in this Example further includes a power module 20 and a cross-drill pipe communication module. Exemplarily, the power module is a downhole turbine generator, and the cross-drill pipe communication module is a mud pulser. The power module and the cross-drill pipe communication module are both disposed at an upper end of the controllable flexible WOB & torque transmission drilling string, so as to solve the problem that the downhole power module 20 and the cross-drill pipe communication module cannot enter the short-radius well section together with the controllable flexible WOB & torque transmission drilling string due to large sizes and long lengths, thereby realizing the short angle building hole rate. According to the present disclosure, the lengths of the drill bit 100 and the controllable flexible WOB & torque transmission drilling string 200 are greater than a preset length of the short-radius well section and its extended well section, so that during drilling, the power module 20 and the cross-drill pipe communication module are always kept in the main borehole without entering branch wells. The electrical cable disposed in the controllable flexible WOB & torque transmission drilling string is electrically connected to the electrical actuator and its related measurement module and control circuit, so as to provide power and/or communication connections for the electrical actuator, the measurement module and the control circuit.

To sum up, according to the short-radius trajectory-controllable drilling tool provided by the present disclosure, the every two adjacent load-bearing joints are hinged by means of the deflectable WOB & torque transmission assembly so as to form the controllable flexible WOB & torque transmission drilling string, which realizes the engineering feasibility and practical value of the short-radius directional drilling technology for thin reservoir exploitation, residual oil digging potential, exploitation of horizontal wells in sub-salt reservoirs, combined exploitation of multiple series of strata, coalbed methane exploitation, and exploitation of soft or even liquid solid minerals such as hydrates, and further achieves the short angle building hole rate. The steering actuator can drive the axis of the drill bit to controllably deviate from the axis of the load-bearing body via the deflecting lever, thus realizing the guiding function.

As shown in FIG. 8 to FIG. 11, the present disclosure provides a combined type steerable drilling tool, which includes a steerable joint. The steerable joint includes a force transfer cylinder 1 and a load-bearing body 2. The load-bearing body 2 is disposed inside the force transfer cylinder 1. That is, the load-bearing body 2 is inserted inside the force transfer cylinder 1. An upper portion of the load-bearing body 2 is hinged to the force transfer cylinder 1 by means of an inner hinge structure 3, and the length of the load-bearing body 2 is less than that of the force transfer cylinder 1. Alternatively, an upper portion of the force transfer cylinder 1 is hinged to the load-bearing body 2 by means of the inner hinge structure 3, and the length of the load-bearing body 2 is greater than that of the force transfer cylinder 1. Therefore, the load-bearing body 2 and the force transfer cylinder 1 can be allowed to relatively deflect. A drill bit 4 is connected to a lower end of the load-bearing body 2, and an axis of the drill bit 4 can be deflected towards the guiding direction and around the inner hinge structure 3. An annular activity space 5 is provided between the force transfer cylinder 1 and the load-bearing body 2. At least three groups of driving hydraulic cylinders 21 are disposed at intervals along the circumferential direction at a lower portion of the load-bearing body 2. Exemplarily, all the driving hydraulic cylinders 21 are evenly disposed along the circumferential direction of the load-bearing body 2. Each of the driving hydraulic cylinders 21 includes a piston structure accommodating cavity 211 disposed in an outer wall of the load-bearing body 2, and a piston structure 212 disposed in the piston structure accommodating cavity 211. The piston structure 212 can drive the force transfer cylinder 1 and the load-bearing body 2 to move relative to each other, so that the drill bit 4 at the lower end of the load-bearing body 2 can cut the stratum in a symmetrical orientation laterally.

The combined type steerable drilling tool provided by the present disclosure can greatly reduce the size of rotary steering and can precisely control the rotary steering by disposing the driving hydraulic cylinders 21 between the force transfer cylinder 1 and the load-bearing body 2, thus improving the passability of the combined type steerable drilling tool in a high-curvature borehole. The combined type steerable drilling tool can continue to drill laterally by laterally drilling the short-extremely short radius well sections at a bottom of the main borehole or any other position, thus realizing the extension of a controllable trajectory.

Further, an outer peripheral surface of the force transfer cylinder 1 is connected to a plurality of first centralizers 11 disposed at intervals in the circumferential direction. The force transfer cylinder 1 can drive the first centralizers 11 to abut against the hole-wall. By changing the positions of the first centralizers 11, the distance between a power transmission point of the force transfer cylinder 1 transmitting a thrust to the hole-wall and the drill bit 4 can be reduced, which is helpful to overcome the interference of the rear hole enlargement of the drill bit 4 and drive the piston structure 212 to transmit the thrust to the hole-wall.

Further, the combined type steerable drilling tool also includes a drive drill string 6. The drive drill string 6 includes a plurality of transmission joints 61 hinged sequentially from top to bottom. The transmission joints 61 are used to bear a torque. Each of the transmission joints 61 is provided with a through hole 611 . The plurality of through holes 611 are in fluid communication with each other sequentially to form a through flow channel 62 for the circulation of the drilling circulating medium. The main flow channel for the circulation of the drilling circulating medium is formed by the through flow channel 62, so that the circulation of the drilling circulating medium in the drive drill string 6 is realized. The lowermost transmission joint 61 is fixedly connected to an upper end of the force transfer cylinder 1, or the lowermost transmission joint 61 is fixedly connected to an upper end of the load-bearing body 2, so that the drive drill string 6 is allowed to be capable of transmitting the power of rotary drilling for the drill bit 4.

During use, the drive drill string 6 is guided in a rotating state in a short-radius borehole. Under this condition, because the drive drill string 6 is generally rotating in a directional drilling process, a main force component of the friction is a tangential direction of the circumference of the drive drill string 6, which greatly reduces the axial friction, and realizes the trajectory control in an ultra-short-radius borehole.

It should be noted that the total length of the short-extremely short radius well sections that can be drilled by the combined type steerable drilling tool does not exceed the total length of the drill bit 4, the steerable joint and the drive drill string 6.

Further, the deflection angle between the two adjacent transmission joints 61 is 0.5°-8° to prevent the excessive buckling of each of the transmission joints 61 in a WOB & torque transmission process from impeding the transmission of WOB and torque. When the deflection angle between the two adjacent transmission joints 61 reaches a deflection limit, the minimum radius of curvature that can be formed in a lateral drilling section should be greater than or equal to that of the preset short-extremely short radius well section.

Further, at least one universal joint 63 capable of transmitting rotary drilling power is disposed inside the transmission joints 61, and the distance between the every two adjacent universal joints 63 is less than 1 m, so that the section between the drill bit 4 and the uppermost transmission joint 61 can reach an enough curvature to complete short-radius well drilling and maximize whipstocking. In addition, under the same whipstocking performance condition, or under the same high-curvature borehole passability condition, the deflection limit of each deflection point can be reduced by shortening the length of each transmission joint 61, that is, shortening the distance between two deflection points, so as to protect the transmission joints 61 from damage and reduce downhole vibration, and especially protect the universal joints 63 used to transmit the rotary drilling power in the transmission joints 61 from damage.

Under normal circumstances, the distance between the two adjacent universal joints 63 is within 0.4 m, which allows the steerable joint to pass through the short-extremely short radius well sections, and then facilitates the completion of the drilling of the extended well sections of the short-extremely short radius well sections. The purpose of limiting the distances among all the universal joints 63 of the drive drill string 6 is to prevent the excessive buckling of each of the transmission joints 61 in a WOB & torque transmission process from impeding the transmission of WOB and torque, and to prevent the excessive buckling of the drive drill string 6 from interfering with the well trajectory control of the steerable joint. It should be noted that when the combined type steerable drilling tool is drilling a short-radius extended well section, there is always a small section of the drive drill string 6 in the short-extremely short radius well section. As a result, the drilling tool will be excessively buckled if the preset deflection limit angle between the two adjacent transmission joints 61 is too large, which will affect the well trajectory control of a high-passability steering actuator. However, the drilling tool cannot smoothly pass through the short-extremely short radius well section if the preset deflection limit angle therebetween is too small. Therefore, in order to further improve the stability of WOB & torque transmission and increase the power transmission efficiency of rotary drilling, the deflection angle between the two adjacent transmission joints 61 should be controlled within 3°.

Further, each universal joint 63 includes a ball joint 631 and a ball socket 632. An outer surface of the ball joint 631 is provided with a torque transfer slot, and an inner surface of the ball socket 632 is fixedly provided with a driving pin. Alternatively, the inner surface of the ball socket 632 is provided with a torque transfer slot, and a driving pin is fixedly disposed on the outer surface of the ball joint 631. The driving pin can be rotatably embedded in the torque transfer slot, and torque transmission is realized via the cooperation of the driving pin and the torque transfer slot.

Alternatively, the universal joints 63 are constant velocity universal joints 63 to avoid the inconsistency of the rotational speeds of a power input end and a power output end, thus preventing the adverse impact caused by the rotational speed fluctuation of an output end of the drive drill string 6 on the steering accuracy of the steerable joint.

Alternatively, the universal joints 63 may also use any other existing structure that can transmit torques. For example, the ball joints 631 and the ball sockets 632 may also transmit torques by relying on key grooves or tooth grooves to engage with each other.

Further, the minimum distance between deflection centers of the two adjacent transmission joints 61 is less than 5 times the diameter of the drill bit 4, which can reduce the distance between hinge points. When the drive drill string 6 vibrates, no longer moment arm causing the breakage of a hinged part will be formed at either end of each hinge point.

Further, the load-bearing body 2 is internally provided with an electric drive actuator 22 and a hydraulic diverter 23. The electric drive actuator 22 is connected to the hydraulic diverter 23. Each of the driving hydraulic cylinders 21 can be in fluid communication with the hydraulic diverter 23 by means of flow channels 24, respectively. The electric drive actuator 22 can drive the hydraulic diverter 23 to dispense fluid for all the driving hydraulic cylinders 21 and distribute hydraulic fluid to all the driving hydraulic cylinders 21, so as to control the hydraulic pressure state of each of the piston structures 212.

It should be noted that the source of a hydraulic force may be a hydraulic power system, or drilling working fluid in the main flow channel. In the embodiment, the pressure is derived from a pressure difference between the main flow channel and the annular space of a borehole. The process of the drilling circulating medium flowing from the main flow channel into the annular space of the borehole through a water hole reserved in the drill bit 4 will produce a greater pressure drop, which is the pressure required by the piston structures 212.

Each of the piston structures 212 includes a piston structure and a plunger structure. If the piston structures or plunger structures are used to directly push against the hole-wall, there is no need for an independent pushing support piece. That is, the hydraulic pressure in the piston structure accommodating cavity 211 is used to directly push the piston structures 212 so as to make the piston structures 212 push against the hole-wall to transmit thrust.

Figure 9:
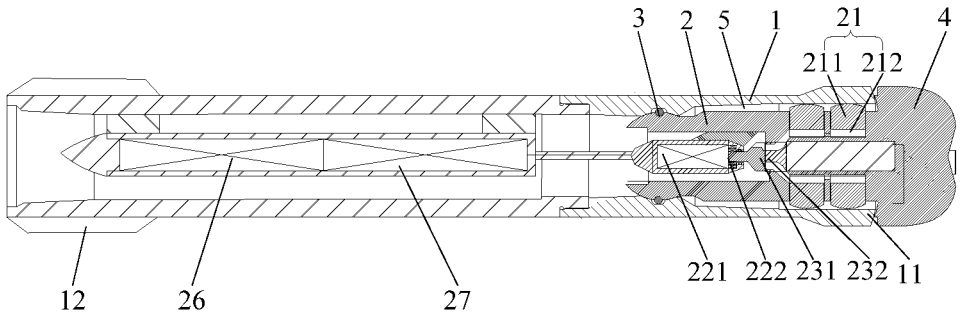
FIG. 9 is a schematic diagram of the structure of an execution joint according to a first embodiment.

In one implementation of the present disclosure, as shown in FIG. 9, the electric drive actuator 22 is a motor. The motor includes a motor stator 221 and a motor rotor 222. The hydraulic diverter 23 is a rotary valve. The rotary valve includes a rotary valve stator 231 and a valve element 232. The valve element 232 is coupled to the motor rotor 222. That is, during the steering drilling process, the motor rotor 222 can drive the valve element 232 to rotate relative to the rotary valve stator 231. The rotary valve stator 231 is provided with a plurality of liquid supply windows which are respectively disposed corresponding the driving hydraulic cylinders 21 on a one-to-one basis. The liquid supply windows are in fluid communication with the driving hydraulic cylinders 21 by means of the flow channels 24. The valve element 232 can control the connected state between all the liquid supply windows and the through flow channel 62. Specifically, the piston structures 212 is pushed by the hydraulic fluid under the fluid distribution action of the hydraulic diverter 23 to push against the force transfer cylinder 1 in the radial direction of the steerable joint. The force transfer cylinder 1 is pushed against the hole-wall. A resultant force produced by all the piston structures 212 which periodically push against the hole-wall in its radial direction causes the drill bit 4 to deflect to complete the guided drilling operation. Exemplarily, the valve element 232 is disposed at the end of the steerable joint, and is located at the side of each driving hydraulic cylinder 21 away from the drive drill string 6, thus minimizing the length of the load-bearing body 2. Therefore, it is beneficial for the combined type steerable drilling tool to pass through the short-extremely short radius well section with higher curvature.

During steering, the hydraulic diverter 23 is driven by the electric drive actuator 22 to make a liquid supply end on the valve element 232 of the hydraulic diverter 23 face the opposite direction of the steering direction, so as to provide high-pressure fluid to the piston structures 212 in a sector positioned in the opposite direction of the steering direction, so that the liquid supply windows on the valve element 232 and the equivalent flow area leading to the through flow channel 62 are larger than the equivalent flow area of a bypass throttling structure. At this time, the piston structures 212 will drive the force transfer cylinder 1 radially to push against the hole-wall. On the contrary, the fluid in each of the piston structure accommodating cavities 211 in a sector where the steering direction is located will be discharged from the bypass throttling structure. The sector where the steering direction is located refers to a range not exceeding ±90° of the steering direction.

Figure 10:
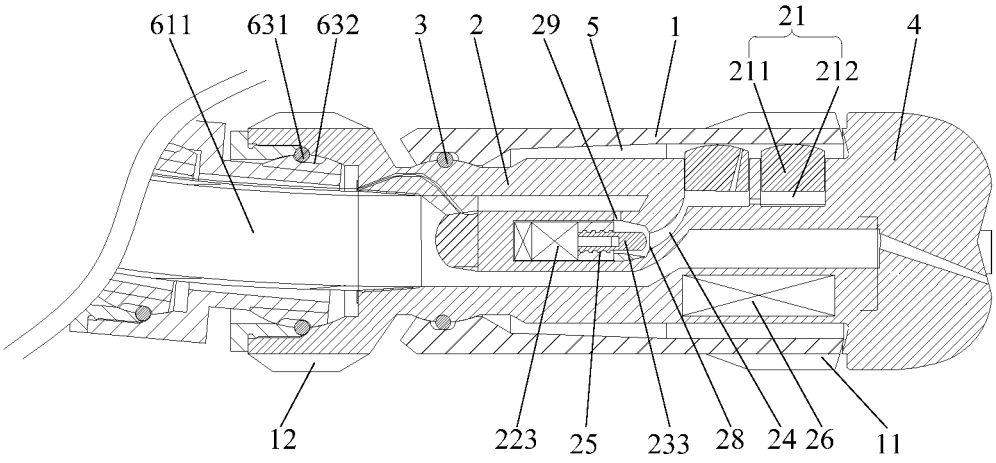
FIG. 10 is a schematic diagram of the structure of an execution joint according to a second embodiment.

In another implementation of the present disclosure, as shown in FIG. 10, the hydraulic diverter 23 includes at least one reversing valve 233. The electric drive actuator 22 includes swing motors 223 disposed corresponding to the reversing valves 233. The swing motors 223 can drive the reversing valves 233 to make reciprocating motion by means of lead screws 25. Specifically, the electric drive actuator 22 is composed of the plurality of swing motors 223 which are respectively disposed corresponding to all the driving hydraulic cylinders 21 on a one-to-one basis and can make reciprocating motion. The hydraulic diverter 23 is composed of the reversing valves 233 which are disposed corresponding to all the swing motors 223 on a one-to-one basis. The swing motors convert the rotary motion into the reciprocating motion which can drive the reversing valves 233 to act by means of the lead screws 25 or gear racks so as to control the action of the reversing valves 233. The reversing valves 233 act as the hydraulic diverter 23 under the control of a control circuit 7 to realize the opening and closing between a first path 28 and a second path 29. The specific steering mode of this implementation is basically the same as those of the above embodiments, and will not be repeated here.

Figure 11:
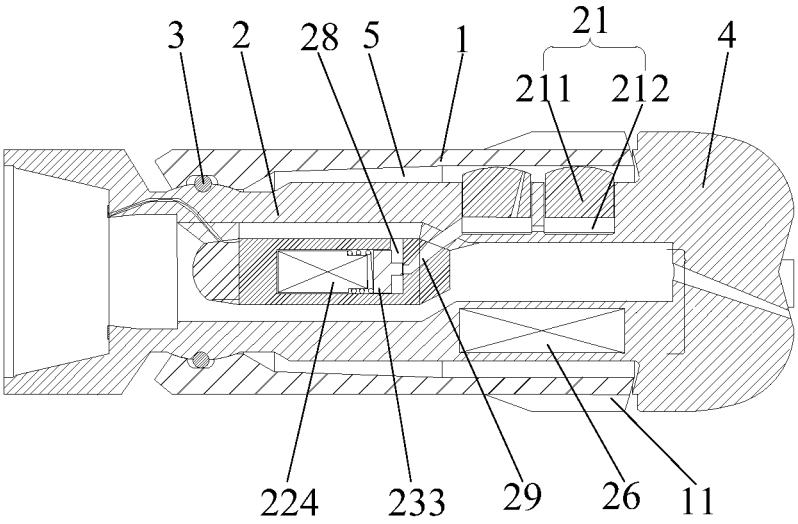
FIG. 11 is a schematic diagram of the structure of an execution joint according to a third embodiment.

In still another implementation of the present disclosure, as shown in FIG. 11, the hydraulic diverter 23 includes at least one reversing valve 233. The electric drive actuator 22 includes electromagnets 224 disposed corresponding to the reversing valves 233. The electromagnets 224 are connected to the reversing valves 233 and can drive the reversing valves 233 to open and close. Specifically, the electric drive actuator is composed of the plurality of electromagnets 224 which are respectively disposed corresponding to all the driving hydraulic cylinders 21 one by one. The hydraulic diverter 23 is composed of the plurality of reversing valve 233 which are disposed corresponding to all the electromagnets 224 one by one. The electromagnets 224 are electrically connected to the control circuit 7, and can drive the reversing valves 233 to open and close the first path 28 and the second path 29 under the control of the control circuit 7. The first path 28 is in fluid communication with the driving hydraulic cylinders 21, and the second path 29 is in fluid communication with the through flow channel 62. When the electromagnets 224 open valve paths, the high pressure drilling fluid in the through flow channel 62 can be periodically brought into fluid communication with the driving hydraulic cylinders 21. Specifically, the control circuit 7 opens the path for the reversing valves 233 corresponding to the driving hydraulic cylinders 21 that is not located in an area in the steering direction, so that the high pressure fluid in the through flow channel 62 flows into the driving hydraulic cylinders 21 through the reversing valves 233. Therefore, a large pressure difference is produced between the inside and outside of the piston structures 212, which makes the piston structures 212 push against the hole-wall to generate a steering thrust. Correspondingly, when the reversing valves 233 corresponding to the driving hydraulic cylinders 21 located in the area in the steering direction are closed, the drilling fluid is discharged out of the piston structures through the throttling structure without generating the thrust. The drilling fluid in the through flow channel 62 is periodically distributed to all the driving hydraulic cylinders 21 under the control of the electromagnets 224 with the rotation of the drill string. A resultant force generated by all the driving hydraulic cylinders 21 pushing against the hole-wall radially makes the drill bit 4 deflect, thus changing the well trajectory.

It should be noted that the problem to be solved by the present disclosure is to realize short-extremely short radius steerable drilling and to continue to drill and extend boreholes. The electric drive actuator 22 and the hydraulic diverter 23 are equally replaced by any means, which are all within the protection scope of the present disclosure.

Further, an upper end of the drive drill string 6 is connected to a power supply joint 64. The power supply joint 64 includes a battery and/or a downhole generator. The power supply joint 64 is electrically connected to the electric drive actuator 22 by means of an electrical cable 65 to realize the power supply for the electric drive actuator 22.

Further, the upper end of the drive drill string 6 is coupled to a relay communication device 66. The relay communication device 66 is electrically connected to the electrical cable 65. Specifically, one end of the relay communication device is electrically connected to the electrical cable 65, and the other end of the relay communication device 66 can communicate with a wellhead end remotely. A ground device or personnel can monitor the guiding function and attitude of the steerable joint by means of the relay communication device 66, so that the function of controllable trajectory is better realized.

Further, the load-bearing body 2 is internally provided with a measuring device 26. The measuring device 26 includes an acceleration sensor and/or a magnetic sensor and/or a gyroscope. Exemplarily, the measuring device 26 at least includes a three-axis acceleration sensor and a three-axis magnetic sensor to measure the tilt angle, azimuth angle and tool face angle of the steerable joint.

Still further, the measuring device 26 also includes a measuring circuit 27 manufactured by a thick film circuit process. The measuring circuit 27 includes at least one digital chip to calculate the tool attitude near the drill bit 4.

Further, a second centralizer 12 is connected to an outer part of the lowermost transmission joint 61. The combined action of the second centralizer 12 and the drill bit 4 can minimize the impact of the large swing of the drilling tool caused by the first universal joint 63 counted from front to back on the measuring accuracy of the measuring device 26.

Alternatively, the combined type steerable drilling tool also includes a second centralizer 12. The second centralizer 12 is fixedly connected to an outer side of the force transfer cylinder 1, or the second centralizer 12 is disposed at an outer side of the load-bearing body 2 and positioned above the force transfer cylinder 1. The second centralizer 12 can enable the steerable joint to be elastically connected to the drive drill string 6 connected behind the steerable joint, which allows the steerable joint and the drive drill string 6 connected behind the steerable joint to have a tendency of maintaining a coaxial characteristic.

Further, the piston structure accommodating cavity 211 and the load-bearing body 2 are integrated into a one-piece structure, which facilitates processing and manufacturing.

It should be noted that the rotation described in the present disclosure refers to the rotation around its axis.

A circuit board, a circuit module, a control module, a control circuit, and the like described in the present disclosure generally need to be protected by pressure-bearing housings or disposed in accommodating cavities made of instrument metal structure species, and certain sealing measures are required to prevent the fluid in boreholes from contacting the circuit board. The specific method is common general knowledge in the art, and will not be repeated here.

The present disclosure also provides a combined type steerable drilling method, which includes the following steps:

Step 210: A whipstock is lowered to perform lateral drilling, and a whipstocking face of the whipstock is caused to face the azimuth direction of a main borehole. Specifically, a conventional drill string is used to drive the drill bit 4 by means of a flexible drill pipe with a certain length, so as to enable the drill bit 4 to complete the lateral drilling of a short-extremely short radius well section under the action of a WOB and an oblique force provided by the whipstock. The total length of the flexible drill pipe and the drill bit 4 shall not be less than that of the short-extremely short radius well section.

Step 220: The combined type steerable drilling tool is lowered to drill an extended well section, and is supported by the whipstock in the main borehole. Specifically, the flexible drill pipe and the high-deviation drill bit 4 are pulled out from the borehole, the combined type steerable drilling tool is lowered and passed through the drilled short-extremely short radius well section, and then the drilling of the extended well section is completed. When the main borehole is an inclined shaft, and the azimuth angle of the main borehole is different from those of branch boreholes, the azimuth angle of the extension well section shall be gradually changed in the process of drilling the extension well section so as to gradually reach an ideal angle.

It should be noted that in some special cases, for example, if sidetrack drilling is carried out in the well section where the hole deviation and azimuth of the main borehole change at the same time, a cylindrical coordinate system is set up in the main borehole at a point subjected to windowing, and the windowing is carried out in the direction with the highest full-angle change rate; and the short-extremely short radius drilling is further completed. Further, the drilling of the extended well section is then completed. In the process of drilling the extended well section, the direction of the extended well section is gradually moved to the design direction of the extended well section.

In summary, the combined type steerable drilling tool and method provided by the present disclosure greatly reduces the size of the rotary steerable and can precisely control the rotary steering by disposing the driving hydraulic cylinders between the force transfer cylinder and the load-bearing body, thus improving the passage capacity of the combined type rotary steerable drilling tool in a high-curvature borehole. The combined type steerable drilling tool can continue to drill laterally by laterally drilling the short-extremely short radius well sections at a bottom of the main borehole or any other position, thus realizing the extension of a controllable trajectory The combined type steerable drilling tool and method provided by the present disclosure can realize directional drilling of a short-radius drill string under rotating conditions by the drive drill string, which effectively solves the problem of borehole extension of short-extremely short radius wells, and realizes the engineering feasibility and practical value of the short-radius directional drilling technology for combined exploitation of oil and gas resources in multiple series of strata, thin hydrocarbon reservoir exploitation, residual oil digging potential, coalbed methane exploitation, and exploitation of other minerals.

The combined type steerable drilling tool and method provided by the present disclosure can prevent the situation that the hole-wall is damaged by an impact force caused by the strenuous vibration produced by the drive drill string in the borehole.

The combined type steering drilling tool and method provided by the present disclosure adopt the thick film circuit process to make the measuring circuit, which can minimize the size of the measuring circuit and improve the anti-vibration performance of the measuring circuit.

The combined type steering drilling tool and method provided by the present disclosure define the relative positions and diameters among hinge points of the transmission joints, the driving hydraulic cylinders and the drill bit, so as to meet the requirement of the high-curvature borehole for the passability of the tool.

The foregoing descriptions are merely illustrative specific implementations of the present disclosure, and are not intended to limit the scope of the present disclosure. Any equivalent changes and modifications made by any person skilled in the art without departing from the concept and principle of the present disclosure shall fall within the protection scope of the present disclosure.

What is claimed is:

1. A short-radius trajectory-controllable drilling tool, comprising:

a drill bit; and a controllable flexible WOB & torque transmission drilling string, comprising:

a deflecting lever, wherein a lower end of the deflecting lever is fixedly connected to the drill bit;

an electrical actuator; and a plurality of load-bearing joints, wherein every two adjacent load-bearing joints are hinged by means of a deflectable WOB & torque transmission assembly, a lowermost load-bearing joint among the plurality of load-bearing joints is a load-bearing body, and a steering actuator is disposed on the load-bearing body; a lower portion of the deflecting lever is hinged to a lower portion of the loading-bearing body by means of a controllable WOB & torque deflection transmission assembly, and a flexible interstice is formed between the deflecting lever and the load-bearing body; and the steering actuator is disposed in the flexible interstice and located above the controllable WOB & torque deflection transmission assembly, and the steering actuator is capable of driving the deflecting lever to swing around the controllable WOB & torque deflection transmission assembly and/or to rotate circumferentially about an axis of the load-bearing body.

2. The short-radius trajectory-controllable drilling tool according to claim 1, wherein the controllable flexible WOB & torque transmission drilling string further comprises a first centralizer and a second centralizer, and wherein:

the first centralizer is disposed between the steering actuator and the drill bit and located at an outer side of the load-bearing body, or the first centralizer is disposed between the steering actuator and the drill bit and located at an outer side of the deflecting lever; and the second centralizer is disposed adjacent to the first deflectable WOB & torque transmission assembly disposed above the load-bearing body.

3. The short-radius trajectory-controllable drilling tool according to claim 1, wherein:

a length of an upper moment arm of the deflecting lever is greater than 30% of a distance between the controllable WOB & torque deflection transmission assembly and the deflectable WOB & torque transmission assembly disposed above and adjacent to the controllable WOB & torque deflection transmission assembly; and a length of a lower moment arm of the deflecting lever is less than 50% of a distance between the controllable WOB & torque deflection transmission assembly and the deflectable WOB & torque transmission assembly disposed above and adjacent to the controllable WOB & torque deflection transmission assembly.

4. The short-radius trajectory-controllable drilling tool according to claim 3, wherein a distance between the steering actuator and a lower end of the drill bit is greater than 50% of a distance between the lower end of the drill bit and the deflectable WOB & torque transmission assembly disposed above and adjacent to the steering actuator.

5. The short-radius trajectory-controllable drilling tool according to claim 1, wherein:

the deflecting lever is inserted inside the load-bearing body, the steering actuator is an eccentric ring, and the load-bearing body is provided with a drive motor; and the drive motor is sleeved over the deflecting lever in an encircled manner, the eccentric ring is disposed above the drive motor and is connected to a rotor output end of the drive motor, the drive motor is capable of driving the eccentric ring to rotate, a bearing is disposed in an interval between the eccentric ring and the deflecting lever, and the deflecting lever is capable of being driven to swing around the controllable WOB & torque deflection transmission assembly and/or to rotate circumferentially about the axis of the load-bearing body by means of the rotation of the eccentric ring.

6. The short-radius trajectory-controllable drilling tool according to claim 1, wherein:

the deflecting lever is inserted inside the load-bearing body, and the load-bearing body is provided with a solenoid valve;

the steering actuator comprises at least one group of driving hydraulic cylinders disposed along a radial direction of the load-bearing body, and the driving hydraulic cylinders are disposed at intervals;

each driving hydraulic cylinder comprises a cylinder connected to a side wall of the load-bearing body, and a piston disposed in the cylinder; and the solenoid valve is capable of periodically driving the piston to move along the radial direction of the load-bearing body, and the deflecting lever is capable of being driven to rotate around the controllable WOB & torque deflection transmission assembly by means of the movement of the piston.

7. The short-radius trajectory-controllable drilling tool according to claim 1, wherein:

the deflecting lever is an articulated sleeve, and the steering actuator is connected to a side wall of the load-bearing body;

the steering actuator comprises at least one group of driving hydraulic cylinders disposed along a radial direction of the load-bearing body, and the driving hydraulic cylinders are disposed at intervals;

each driving hydraulic cylinder comprises a cylinder connected to the side wall of the load-bearing body, and a piston disposed in the cylinder and capable of abutting against an inner wall of the articulated sleeve;

the load-bearing body is internally provided with a flow channel, and the load-bearing body is further provided with the electrical actuator; and the electrical actuator comprises a rotary valve drive motor and a rotary valve, the rotary valve comprises a rotary valve disc and a rotary valve seat, the rotary valve seat is in fluid communication with the driving hydraulic cylinder, and the rotary valve drive motor is capable of driving the rotary valve to periodically bring the flow channel into fluid communication with the driving hydraulic cylinder.

8. The short-radius trajectory-controllable drilling tool according to claim 1, further comprising an attitude measurement sensor for measuring a gravity toolface angle or a magnetic toolface angle.

9. The short-radius trajectory-controllable drilling tool according to claim 1, wherein a deflection angle of the controllable WOB & torque deflection transmission assembly is 0°-15°.

10. The short-radius trajectory-controllable drilling tool according to claim 9, wherein the controllable WOB & torque deflection transmission assembly comprises a transmission universal joint and a bearing sleeve sleeved over the transmission universal joint, an interstice is provided between the bearing sleeve and the transmission universal joint to form a deflection space, and the transmission universal joint is capable of deflecting by 0°-15° relative to an axis of the bearing sleeve in the deflection space.

11. The short-radius trajectory-controllable drilling tool according to claim 1, further comprising a power module and a mud pulser, both of which are disposed at an upper end of the controllable flexible WOB & torque transmission drilling string.

12. The short-radius trajectory-controllable drilling tool according to claim 1, wherein:

each of the load-bearing joints is provided with a through structure along the axis direction, and a flow tube is fixed in the load-bearing body along the axial direction;

an outlet of the flow tube is located below the controllable WOB & torque deflection transmission assembly and is in fluid communication with the drill bit; and an inlet of the flow tube is disposed above the controllable WOB & torque deflection transmission assembly and is in fluid communication with the through structures.

13. The short-radius trajectory-controllable drilling tool according to claim 1, wherein an isolation centralizer is sleeved over the load-bearing joint adjacent to the load-bearing body, and a distance between the isolation centralizer and an upper end of the load-bearing body is not more than 10 times the diameter of a borehole.

14. The short-radius trajectory-controllable drilling tool according to claim 1, further comprising a displacement sensor for measuring a relative motion of the deflecting lever and the load-bearing body.

15. A combined type steerable drilling tool, comprising a force transfer cylinder and a load-bearing body, wherein:

the load-bearing body is disposed inside the force transfer cylinder, and an upper portion of the load-bearing body is hinged to the force transfer cylinder by means of an inner hinge structure, or an upper portion of the force transfer cylinder is hinged to the load-bearing body by means of the inner hinge structure;

a drill bit is connected to a lower end of the load-bearing body, an annular activity space is provided between the force transfer cylinder and the load-bearing body, and a steering actuator is disposed in the annular activity space and is capable of driving the force transfer cylinder and the load-bearing body to move relative to each other;

the steering actuator comprises at least one group of driving hydraulic cylinders disposed at intervals along a circumferential direction at a lower portion of the load-bearing body;

each driving hydraulic cylinder comprises a piston structure accommodating cavity disposed in an outer wall of the load-bearing body, and a piston structure disposed in the piston structure accommodating cavity and capable of driving the force transfer cylinder and the load-bearing body to move relative to each other; and an outer peripheral surface of the force transfer cylinder is connected to a first centralizer in the circumferential direction, and the force transfer cylinder is capable of driving the first centralizer to abut against a hole-wall.

16. The combined type steerable drilling tool according to claim 15, further comprising a drive drill string, the drive drill string comprising a plurality of drive joints hinged from top to bottom in turn, wherein:

an interior of each drive joint is provided with a through hole, and the plurality of through holes are in fluid communication with each other sequentially to form a through flow channel for a circulation of a drilling circulating medium; and a lowest drive joint among the plurality of drive joints is fixedly connected to an upper end of the force transfer cylinder, or the lowest drive joint is fixedly connected to an upper end of the load-bearing body.

17. The combined type steerable drilling tool according to claim 16, wherein a deflection angle between the every two adjacent drive joints is 0.5°-8°.

18. The combined type steerable drilling tool according to claim 16, wherein at least one universal joint capable of transmitting rotary drilling power is disposed inside the drive joint.

19. The combined type steerable drilling tool according to claim 16, wherein the load-bearing body is internally provided with an electric drive actuator and a hydraulic diverter connected to each other; and each driving hydraulic cylinder is capable of being in fluid communication with the hydraulic diverter via a channel.

* * * * *